United States Patent [19]

Matsugo et al.

[11] 4,198,151

[45] Apr. 15, 1980

[54] SYSTEM FOR REPLENISHING DEVELOPER

[75] Inventors: Ryuzo Matsugo, Tokyo, Japan;

[73] Assignees: Sumiyoshi Denki Kabushiki-Kaisha, Tokyo, Japan

[21] Appl. No.: 23,181

[22] Filed: Mar. 23, 1979

[51] Int. Cl.[2] ..... G03D 13/00

[52] U.S. Cl. ..... 354/298; 354/324; 137/93

[58] Field of Search ..... 354/298, 324; 137/93; 250/477, 559, 578; 355/10, 27; 356/443, 444; 354/298, 324; 137/93

[56] References Cited

U.S. PATENT DOCUMENTS

| | | | |
|---|---|---|---|
| 3,561,344 | 2/1971 | Frutiger | 354/298 |
| 3,787,689 | 1/1974 | Fidelman | 354/298 X |
| 3,870,065 | 3/1975 | Minns, Jr. | 137/93 |
| 3,990,088 | 11/1976 | Takita | 354/298 |
| 4,057,818 | 11/1977 | Gaskell et al. | 354/298 |

*Primary Examiner*—L. T. Hix
*Assistant Examiner*—William B. Perkey
*Attorney, Agent, or Firm*—Fred Philpitt

[57] ABSTRACT

Disclosed herewith is a developer replenishment system in an apparatus used in developing photographic films, the system comprises a first integrator to integrate a converted signal of an electric value corresponding to a light radiated from a light source after interfering in a developed film; a second integrator to integrate an electric signal being of a larger rising gradient than said converted signal; a first comparator designed to generate a signal for initiating replenishment of developer when it receives a prescribed electrical value signal and a signal from said first integrator and when the signal value from said integrator reaches the level of said prescribed electrical signal; a drive circuit designed to be driven by said signal for initiating replenishment of developer and to actuate a developer replenishment pump and cause said second integrator to start an operation; a second comparator designed to generate a signal for ceasing replenishment of developer when it receives the signal from said second integrator and the signal from said first integrator and when the former signal value becomes equal to the latter signal value; and a mono-multi circuit designed to be driven by the signal from said second comparator to generate a shot pulse, thereby to cause the operation of said first integrator to be ceased.

7 Claims, 4 Drawing Figures

SYSTEM FOR REPLENISHING DEVELOPER

BACKGROUND OF THE INVENTION

This invention relates to a developer replenishment system in an apparatus used in developing photographic films, characterized in that the time required for replenishing the developer is not seriously affected by the width of a film.

The inventor of this application has previously succeeded in exploiting a method for replenishing developer, as shown in FIG. 4 annexed. According to this method, a signal E4 for initiating the replenishment of developer is arranged to follow the exposed surface integration signals E3*a*, E3*b*, E3*c* after an interval of only the prescribed time t. This method, however, has drawbacks in that it requires large change in the time necessary for replenishing of developer in accordance with a variation of width of the film to be developed. More specifically, this method, when developing a film of narrow width, requires that the time for replenishing the developer be extremely shortened as shown by T3 in FIG. 4, due to the fact that the exposed surface integration signal of the film assumes a gentle slope $\alpha 3$ as indicated by E3, whilst such short replenishment time can not be obtained without instantaneous driving of a motor of a pump, which apparently results in causing damage to the motor. On the other hand, the method requires, when developing a film of broad width, that the time for replenishing the developer be extremely lengthened as shown by T1 in FIG. 4, due to the fact that the exposed surface integration signal of the film assumes a sharp slope $\alpha 1$ as indicated by E3*a*, whilst such lengthy replenishment time might exceed the limit of calculation of an integrator.

BRIEF SUMMARY OF THE INVENTION

It is therefore an object of the present invention to provide a system in which the replenishment of developer is designed to be initiated as the exposed surface integration signal reaches a certain level so that the time for replenishment of developer may be free from variation in width of a film. It will be possible through the use of the present system to prevent the motor from being damaged even when developing a film of narrow width. It will further be possible to develop properly a film of even broad width within the limit of calculation of an integrator.

BRIEF DESCRIPTION OF THE DRAWINGS

The nature of the present invention will become more fully apparent from a consideration of the following description of exemplary embodiment thereof, taken in conjunction with the accompanying drawings, in which.

DETAILED DESCRIPTION OF PREFERRED EMBODIMENTS

Figure 1:
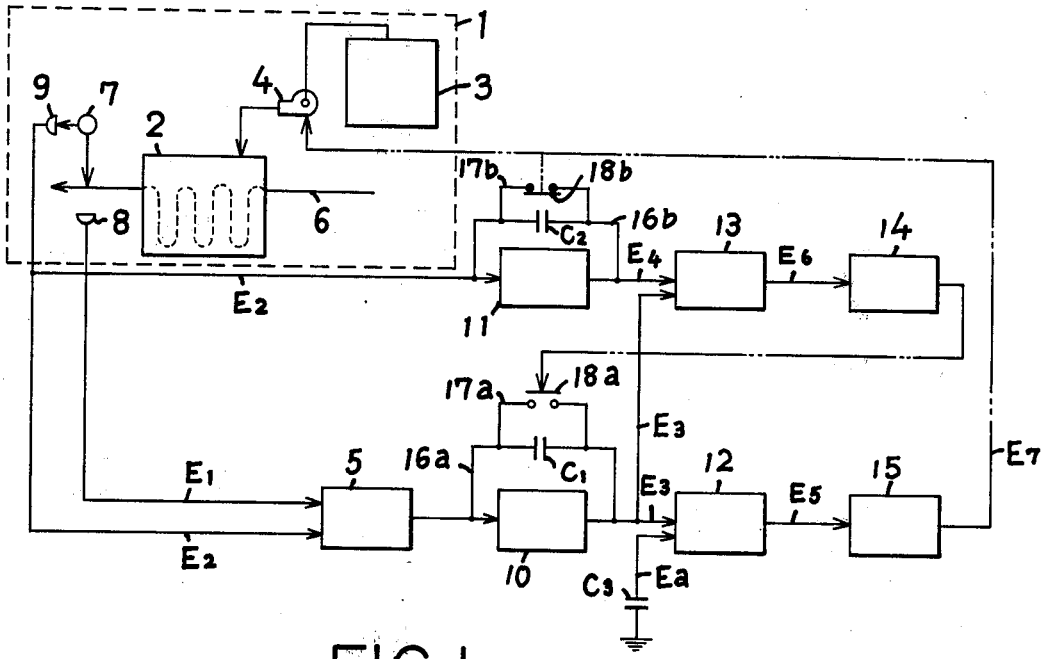
FIG. 1 is a block diagram showing one embodiment of the system according to the present invention.

Referring now to FIG. 1, indicated by a reference numeral 1 is an automatic developing apparatus to convey at a constant speed a film to be developed and to effect development of such film automatically. This automatic apparatus 1 is provided with a developing tank 2 and a reservoir of developer 3. The developer contained in the reservoir 3 is designed to be replenished into the developing tank 2 in proportion to the degree of contamination of the developer contained in the tank 2. Such replenishment of the developer is to be carried out by means of a pump 4.

Designated by a reference numeral 6 is a film to be developed, which film, after having been developed through the tank 2, passes at a constant speed through a space between a light source 7 and a photocell 8, whereby an electric signal E1 responsive to the exposed surface of the film developed will be obtained by the photocell 8.

In the case where the exposed surface of the film is 100%, the output of the electric signal E1 of the photocell 8 remains at 0; in the case of 0%, remains at the maximum output; and in the case of 50%, remains with the output corresponding to such exposed surface percentage.

Designated by a reference numeral 9 is a second photocell to provide an electric signal E2. The electric signal E2 remains at the same maximum output as that of the electric signal E1 from the photocell 8 when the exposed surface of the film is 0% i.e. when the film is a transparent one or no film passes through.

The output E1 from the photocell 8 will be fed to a differential amplifier 5 whilst the output E2 from the photocell 9 will be fed both to the second integrator 11 and to the differential amplifier 5. An operation of $\int E2 \cdot dt$ will be performed by the second integrator 11 and the output amplified through the differential amplifier 5 will be fed to the first integrator 10 to perform an operation of $\int (E2-E1)dt$.

The first integrator 10 is provided with a by-pass 16*a* having a condenser C1, the by-pass 16*a* being installed in a manner to step over the first integrator 10. The second integrator 11 is provided with a by-pass 16*b* having a condenser C2, the by-pass 16*b* being installed in a manner to step over the second integrator 11. Each of the condensers C1, C2 is provided with parallely arranged by passes 17*a*, 17*b* respectively, the by-pass 17*a* having an open contact 18*a* and the by-pass 17*b* having a closed contact 18*b*.

The output E3 from the first integrator 10 is fed to the first comparator 12 to start replenishment and is also fed to the second comparator 13 to interrupt replenishment.

The first comparator 12 is with an input of the basic voltage Ea to start replenishment, C3 being a condenser for the basic voltage, and is designed to generate a signal E5 when the signal E3 from the first integrator reaches the basic voltage Ea, whereby the drive circuit 15 is caused to be driven. The signal E7 from the drive circuit 15 will operate the pump 4 so that the developer contained in the reservoir 3 may be replenished to the developing tank 2. Simultaneously, the signal E7 from the drive circuit 15 will cause the contact 18 be in OFF position so that the second integrator 11 may start integration and the integration signal E4 thereof be fed to the second comparator 13.

The second comparator 13 will produce the signal E6 when the signal E4 from the second integrator reaches the signal E3 of the first integrator, whereby the mono-multi circuit 14 is caused to operate to produce the reset slot pulse E8 and the contact 18*a* of the first integrator will instantly be turned ON to clear the integration signal E3. With the integration signal E3 being cleared, the output E5 from the first comparator 12 will go to 0 and the output E7 from the drive circuit 15 will also go to 0, whereby the pump 4 is caused to cease replenishment, the contact 18*b* of the second integrator 11 is turned ON and the signal E4 is cleared.

Figure 2:
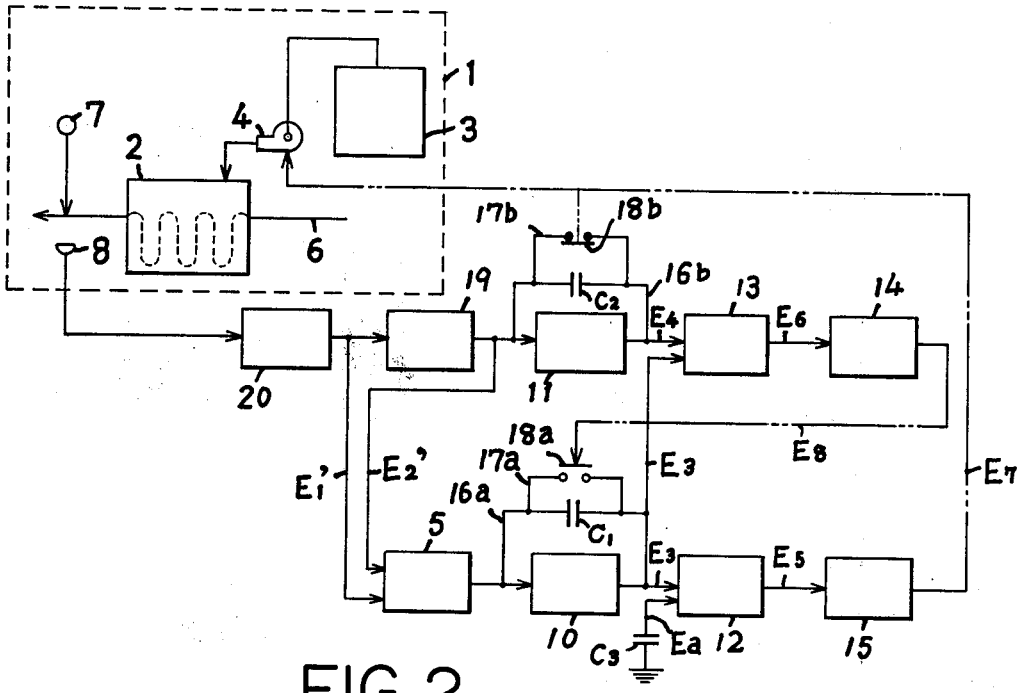
FIG. 2 is a block diagram showing another embodiment thereof.

FIG. 2 shows an embodiment in which the photocell 9 as employed in FIG. 1 is not used. This enbodiment employs, instead of the photocell 9, a peak-level follower 19, which is the only different point from the embodiment in FIG. 1, all other elements being common to both embodiments. Thus reference numerals common to both embodiments are used, with the exception of a current-voltage converter designated by a reference numeral 20.

Figure 3:
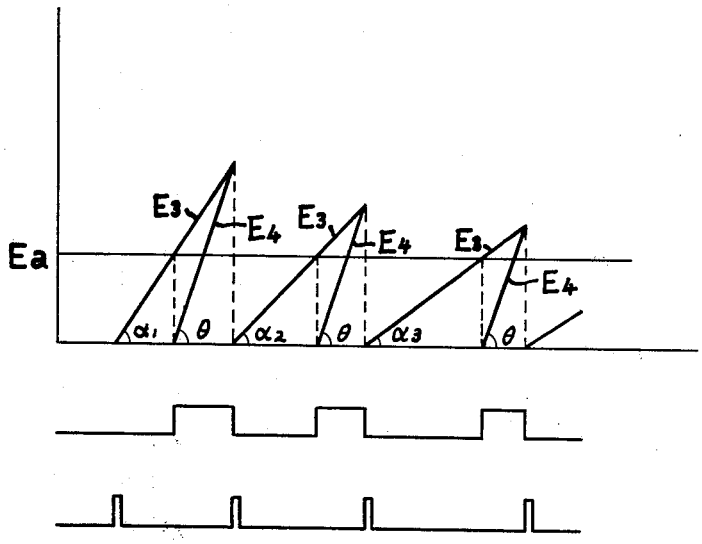
FIG. 3 is a time chart showing integration signals and replenishment time according to the present invention.
Figure 4:
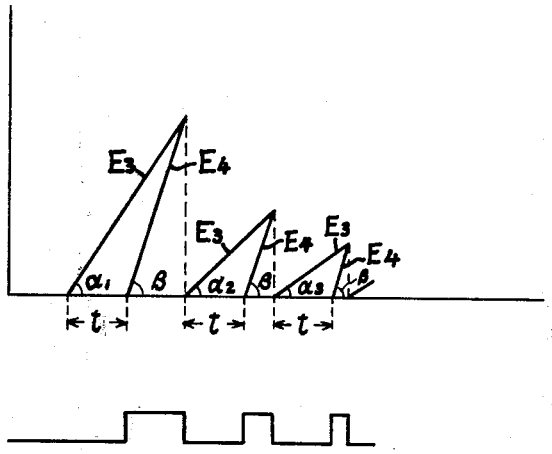
FIG. 4 is a time chart showing integration signals and replenishment time according to a prior art system.

According to the present invention as explained above, replenishment of the developer will be interrupted when the replenishment integration signal E4 becomes equal to the exposed surface integration signal E3, as shown in FIG. 3, whilst the replenishment integration signal E4 will be generated when the exposed surface integration signal E3 reaches the prescribed voltage Ea. It will thus be appreciated that the present system does not require large change in the time necessary for replenishing the developer in accordance with a variation of width of a film to be developed, as will more clearly be understood in FIG. 4 showing a time chart of the prior system in which the replenishment integration signal E4 is designed to follow the exposed surface integration signal E3 after an interval of the prescribed time t.

Accordingly, it will be possible by the use of the present system to prevent the motor from being damaged and to prevent improper replenishment of the developer that might be caused by the inertia of the motor, even when developing a film of narrow width. It will further be possible to properly develop a film of broad width within the limit of calculation of the integrator.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A system for replenishing developer comprising:

(a) a first integrator to integrate a converted signal of an electrical value corresponding to a light radiated from a light source after interferring in a developed film;

(b) a second integrator to integrate an electrical signal being of a larger rising gradient than said converted signal;

(c) a first comparator to generate a signal for initiating replenishment of developer when it receives a prescribed electrical value signal as well as said signal from said first integrator and when such signal from said first integrator reaches the level of said prescribed electrical signal;

(d) a drive circuit to be driven on being given said signal for initiating replenishment of developer and to actuate a developer replenishment pump to cause said second integrator to start an operation;

(e) a second comparator to generate a signal for ceasing replenishment of developer when it receives said signal from said second integrator as well as said signal from said first integrator and when the former signal value becomes equal to the latter signal value; and (f) a mono-multi circuit designed to be driven by said signal from said second comparator to generate a shot pulse, thereby to cause the operation of said first integrator to be ceased.

2. A system for replenishing developer as claimed in claim 1, wherein said first integrator is designed to receive a converted signal of an electrical value corresponding to a light radiated from a light source passing through a developed film.

3. A system for replenishing developer as claimed in claim 1, wherein said first integrator is designed to receive a converted signal of an electrical value corresponding to a light reflected from a developed film facing a light source.

4. A system for replenishing developer as claimed in claim 1, wherein said second integrator is designed to receive a converted signal of an electrical value corresponding to a light radiated from a light source without interferring in the developed film.

5. A system for replenishing developer as claimed in claim 1, wherein said first integrator is designed to receive an amplified signal indicating the difference between a converted signal of an electrical value corresponding to a light radiated from a light source after interferring in a developed film and a converted signal of an electrical value corresponding to a light radiated from a light source without interferring in a developed film; and said second integrator is designed to receive a converted signal of an electrical value corresponding to a light radiated from a light source without interferring in a developed film.

6. A system for replenishing developer comprising:

(a) a first photo element 8 to convert a light radiated from a light source 7 after interferring in a developed film into an electrical value E1 and a second photo element 9 to convert a light radiated from said light source 7 without interferring in said developed film into an electrical value E2;

(b) a differential amplifier 5 to receive said signals E1, E2 from both of said photo elements 8, 9 and to generate an amplified signal indicating the difference between said signals;

(c) a first integrator 10 to receive a signal from said differential amplifier and a second integrator 11 to receive a signal E2 from said second photo element 9;

(d) a by-pass 16*a* installed in a manner to step over said first integrator and having a condenser C1; and a normally opened contact 18*a* installed in a by-pass 17*a* in a manner to step over said condenser C1;

(e) a by-pass 16*b* installed in a manner to step over said second integrator and having a condenser C2; and a normally closed contact 18*b* installed in a by-pass 17*b* in a manner to step over said condenser C2;

(f) a first comparator 12 designed to receive a signal E3 from said first integrator and a basic signal Ea and to generate a signal E5 for initiating replenishment of developer when said signal E3 reaches the same level of said basic signal Ea;

(g) a replenishment drive circuit 15 designed to be driven by said signal E5 for initiating replenishment of developer and to actuate a developer replenishment pump 4 and further to break said normally closed contact 18*b* of the said second integrator;

(h) a second comparator 13 designed to receive said signal from said first integrator and said signal from said second integrator and to generate a signal E6 for ceasing replenishment of developer when both of said signals reach the same level; and (i) a mono-multi circuit 14 to be driven by said signal E6 for ceasing replenishment of developer and to make said normally opened contact 18*a* of said first integrator.

7. A system for replenishing developer comprising:

(a) a converter to convert an electric current being a current converted by a photo element and corresponding to a light radiating from a light source after interferring in a developed film, into a voltage;

(b) a peak-level follower to receive an output voltage from said converter;

(c) a differential amplifier to receive signals from said converter as well as said peak-level follower and to generate an amplified signal indicating the difference between said signals received;

(d) a first integrator to receive said amplified signal from said differential amplifier;

(e) a second integrator to receive a signal from said peak-level follower;

(f) a first comparator to receive a signal from said first integrator as well as a basic signal and to generate a signal for initiating replenishment of developer when such signal from said first integrator reaches the level of said basic signal;

(g) a drive circuit to be driven on being given said signal for initiating replenishment of developer and to actuate a developer replenishment pump to cause said second integrator to start an operation;

(h) a second comparator to generate a signal for ceasing replenishment of developer when it receives said signal from said second integrator as well as said signal from said first integrator and when the former signal value becomes equal to the latter signal value; and (i) a mono-multi-circuit designed to be driven by said signal from said second comparator to generate a shot pulse, thereby to cause the operation of said first integrator to be ceased.

* * * * *